US010524561B2

(12) United States Patent
Flynn

(10) Patent No.: US 10,524,561 B2
(45) Date of Patent: Jan. 7, 2020

(54) MULTIUSE TOOTH CLEANING DEVICES AND PROCESSES FOR USING SAME

(71) Applicant: Joelle S. Flynn, Dana Point, CA (US)

(72) Inventor: Joelle S. Flynn, Dana Point, CA (US)

( * ) Notice: Subject to any disclaimer, the term of this patent is extended or adjusted under 35 U.S.C. 154(b) by 64 days.

(21) Appl. No.: 15/702,505

(22) Filed: Sep. 12, 2017

(65) Prior Publication Data

US 2019/0075921 A1 Mar. 14, 2019

(51) Int. Cl.

| | |
|---|---|
| ***A46B 11/04*** | (2006.01) |
| ***A46B 11/00*** | (2006.01) |
| ***A46B 9/04*** | (2006.01) |
| ***A46B 9/02*** | (2006.01) |

(52) U.S. Cl.

CPC ..... *A46B 11/0027* (2013.01); *A46B 9/025* (2013.01); *A46B 9/04* (2013.01); *A46B 11/0041* (2013.01); *A46B 11/0062* (2013.01); *A46B 11/0086* (2013.01); *A46B 11/0089* (2013.01); *A46B 2200/1066* (2013.01)

(58) Field of Classification Search

CPC ..... A46B 11/0027; A46B 2200/1066
USPC ..... 401/277
See application file for complete search history.

(56) References Cited

U.S. PATENT DOCUMENTS

| | | | | |
|---|---|---|---|---|
| 1,581,277 | A * | 4/1926 | McLaughlin | A46B 11/0027 222/320 |
| 1,946,867 | A * | 2/1934 | Mathieu | A46B 11/0027 401/175 |
| 3,535,421 | A | 10/1970 | James et al. | |
| 3,891,127 | A * | 6/1975 | Fernandez | A46B 11/0027 222/387 |
| 4,013,370 | A | 3/1977 | Gingras | |
| 4,051,234 | A | 9/1977 | Gieske et al. | |
| 4,135,831 | A * | 1/1979 | Reitknecht | A46B 11/0027 401/175 |
| 5,927,889 | A * | 7/1999 | La Flower | A46B 11/0027 132/308 |
| 6,283,658 | B1 | 9/2001 | Estevez et al. | |
| 6,345,629 | B1 | 2/2002 | Vives | |
| 6,397,860 | B1 | 6/2002 | Hill et al. | |
| 7,182,542 | B2 | 2/2007 | Hohlbein et al. | |
| 7,478,959 | B2 | 1/2009 | Hohlbein et al. | |
| 8,016,162 | B2 | 9/2011 | Cleary et al. | |
| 8,715,625 | B1 | 5/2014 | Hart et al. | |

(Continued)

FOREIGN PATENT DOCUMENTS

| | | | |
|---|---|---|---|
| EP | 0132459 A1 * | 2/1985 | A46B 9/04 |
| GB | 2203636 | 10/1988 | |
| GB | 2289212 | 11/1995 | |

OTHER PUBLICATIONS

"International Search Report and Written Opinion" issued in PCT/US2018/050610, dated Nov. 7, 2018, 9 pages.

*Primary Examiner* — Jennifer C Chiang
(74) *Attorney, Agent, or Firm* — Kilpatrick Townsend & Stockton LLP

(57) ABSTRACT

Tooth cleaning devices for portable, discrete use to improve dental hygiene as well as cosmetic appearance of teeth and processes for using same. The devices enable discrete cleaning of teeth after drinking dark-colored beverages or after eating food in social settings when conventional teeth cleaning devices are unavailable or inconvenient. In particular, these devices are designed for multiple uses, so that the same device may be used for teeth cleaning on multiple occasions.

18 Claims, 7 Drawing Sheets

(56) References Cited

U.S. PATENT DOCUMENTS

| | | | | |
|---|---|---|---|---|
| 9,295,228 | B1 | 3/2016 | Schiermeier | |
| 2004/0042841 | A1* | 3/2004 | Noguchi | A46B 11/0079 401/270 |
| 2006/0260635 | A1* | 11/2006 | Dabney | A46B 5/026 132/309 |
| 2010/0230312 | A1 | 9/2010 | Sorrentino et al. | |
| 2011/0239387 | A1 | 10/2011 | Hohlbein et al. | |
| 2012/0160261 | A1 | 6/2012 | Harden | |

* cited by examiner

MULTIUSE TOOTH CLEANING DEVICES AND PROCESSES FOR USING SAME

FIELD OF THE INVENTION

The present disclosure relates generally to devices for cleaning teeth and to processes for using same. Specifically, the disclosure relates to portable tooth cleaning devices, preferably suitable for multiple uses, that allow for discreetly cleaning a user's teeth when conventional tooth cleaning products and/or water are unavailable or inconvenient as well as to methods of using such devices.

BACKGROUND OF THE INVENTION

Good dental hygiene is advantageous for health and cosmetic reasons. Various means exist by which individuals may clean their teeth. The vast majority of tooth cleaning devices are designed consistent with in-home use. For example, conventional tooth brushes are large enough to fit conveniently within a fully clenched hand and have bristles exposed to the open air. Storage of these devices requires containers that are several inches in length and more than one or two inches in diameter. The large size of conventional tooth brushes provides a durable and reusable product that may be used numerous times before the device is substantially degraded to the point necessitating disposal. Although the large size and durability of conventional tooth brushes render them well suited for repeated home use, these characteristics make them inconvenient when away from home or "on-the-go." In addition, water and tooth paste are typically required for the use of conventional tooth brushes, making their use inconvenient or impossible when water and tooth paste are not readily available.

Various other means have been created in attempts to address the need for a more portable tooth cleaning device. For example, U.S. Pat. No. 6,397,860 discloses a single use disposable, waterless tooth brushing assembly that includes a toothbrush, a non-foaming, saliva-activated, oral care composition pre-applied to the bristles of the toothbrush, a small moistened disposable towel for use after tooth cleaning, and a compact, lightweight, two-layer heat-sealed packaging container for pre-use sanitary storage of the toothbrush and towel.

U.S. Pat. No. 7,182,542 discloses a waterless disposable toothbrush that includes a handle having a toothpick connected thereto to enable cleaning between teeth, and a rupturable dispenser containing a dentifrice and being connected in a bristle portion of the toothbrush head for dispensing the dentifrice to the teeth.

U.S. Pat. No. 7,478,959 discloses an oral care toothbrush that includes a head mounted to one end of the handle containing a plurality of oral care elements. An oral care accessory is mounted to the opposite end of the handle. An oral care composition dispenser is mounted to the head within the cleaning field defined by the oral care elements.

U.S. Pub. No. 2011/0239387 discloses an oral care toothbrush that includes a handle having a head at one end of the handle, the head having at least one cleaning element and at least one oral care dispenser. The oral care dispenser releases the oral care matter within about five seconds when exposed to water.

Various packaging methods have also been created in an attempt to conveniently house portable tooth cleaning devices. For example, U.S. Pub. No. 2010/0230312 discloses a package for displaying a plurality of items where the package has first and second containers connectable between an open position and a closed position, each container having an outer surface having at least one elongated protrusion, with the head end extending further outwardly from the package than the tail end. The head end of the at least one protrusion of the first container is proximate to the tail end of the at least one protrusion of the second container in the closed position.

Portable tooth freshening and cleansing devices are becoming more common. For example, "portable" concentrated mouthwash strips have become popular among those who are concerned with dental freshness. Portable interdental brushes have also been developed for facilitating removal of food and plaque while on-the-go.

Gum products have also tried to capitalize on the desire to clean teeth while on the go. Many modern chewing gum manufacturers market at least one significant line of chewing gum as "whitening" or "dental cleaning" gums.

In an effort to cosmetically improve tooth appearance, consumers have increasingly turned to tooth bleaching or whitening. There are many commercially available methods for whitening teeth, such as brushing, bleaching strips, bleaching pens, bleaching gels, laser bleaching, and natural bleaching. Traditionally, at-home whiteners use overnight trays containing a carbamide peroxide gel which reacts with water to form hydrogen peroxide. Some whitening techniques may undesirably open dentinal tubules causing increased tooth sensitivity and potentially resulting in temporary tooth stains after drinking certain dark colored liquids such as coffee, tea or red wine.

In view of the foregoing, the need exists for compact, multi-use, portable ready-to-use tooth cleaner and freshener devices that may be used quickly and discretely in social settings preferably without the need for additional material such as separate tooth paste, cleanser or water. The need also exists for portable and discrete devices for removing dental stains and, in particular, for removing temporary tooth stains resulting from dark colored liquids. The need also exists for improved packaging for such tooth cleaning devices that allow the tooth cleaning devices to be kept clean and fresh until time for use.

SUMMARY OF THE INVENTION

The tooth cleaning devices of the present invention house an oral care composition within a cavity. In one embodiment, the oral care composition is pushed by a plunger assembly through an opening onto bristles on a shoulder assembly for use as a brush for brushing a user's teeth. In another embodiment, the oral care composition is exuded through an opening and onto the bristles by a squeezing a housing of the tooth cleaning device. In preferred embodiments, the tooth cleaning device allows for multiple uses by a user, i.e., is a multiuse tooth cleaning device.

In one embodiment, the disclosure is directed to a tooth cleaning device, comprising: an elongated housing having first and second ends; a shoulder assembly attached to the housing at the first end and comprising a plurality of bristles attached to a distal surface thereof; and a plunger assembly comprising a rotatable dial at the second end of the housing coupled to a helically grooved shaft, and a non-rotatable laterally extending plunger having an outer surface slidably engaged with an inner wall of the housing and a central opening engaged with the helically grooved shaft, wherein the housing defines a housing cavity between the shoulder assembly and the plunger, the housing cavity containing an oral care composition therein, and wherein rotation of the dial causes the shaft to rotate and the non-rotatable plunger to slidably move in the distal direction thereby decreasing housing cavity volume and pushing the oral care composition out of the housing cavity through an opening in the shoulder assembly and onto the bristles.

In another embodiment, the disclosure is directed to a tooth cleaning device, comprising: an elongated flexible housing having a first end and an enclosed second end; and a shoulder assembly enclosing the first end of the housing, the shoulder assembly having a central opening extending longitudinally therethrough and comprising a plurality of bristles surrounding said opening, wherein the bristles are attached to and extend distally from a distal surface of the shoulder assembly, wherein the housing defines a housing cavity between the shoulder assembly and the enclosed second end, the housing cavity containing an oral care composition therein, and wherein compression of the flexible housing by a user decreases housing cavity volume and pushes the oral care composition out of the housing cavity through the opening. In this aspect, the first end of the housing optionally has a cylindrical form and the housing tapers to a seam at the enclosed second end.

In another embodiment, the disclosure is directed to a process for using a tooth cleaning device, comprising: (a) providing the tooth cleaning device, the device comprising: an elongated housing having first and second ends; a shoulder assembly attached to the housing at the first end and comprising a plurality of bristles attached to a distal surface thereof; and a plunger assembly comprising a rotatable dial at the second end of the housing coupled to a helically grooved shaft, and a non-rotatable laterally extending plunger having an outer surface slidably engaged with an inner wall of the housing and a central opening engaged with the helically grooved shaft, wherein the housing defines a cavity between the shoulder assembly and the plunger, the cavity containing an oral care composition therein; (b) gripping the housing; (c) rotating the dial so as to rotate the shaft causing the non-rotatable plunger to slidably move in the distal direction thereby decreasing the cavity volume and pushing the oral care composition out of the cavity through the opening and onto the bristles; and (d) activating the oral care composition with the user's saliva and brushing the user's teeth with the bristles.

In another embodiment, the disclosure is directed to a process for using a tooth cleaning device, comprising (a) providing the tooth cleaning device, the device comprising an elongated flexible housing having a first end and an enclosed second end; and a shoulder assembly enclosing the first end of the housing, the shoulder assembly having a central opening extending longitudinally therethrough and comprising a plurality of bristles surrounding said opening, wherein the bristles are attached to and distally extend from a distal surface of the shoulder assembly, wherein the housing defines a cavity between the shoulder assembly and the enclosed second end, the cavity containing an oral care composition therein; (b) gripping the housing; (c) compressing the flexible housing by a user so as to decrease cavity volume and push the oral care composition out of the cavity through the opening and onto the bristles; and (d) activating the oral care composition with the user's saliva and brushing the user's teeth with the bristles.

The various aspects of the present disclosure can comprise a variety of additional alternative features in any combination. For example, the housing optionally has a lateral cross-sectional shape selected from the group consisting of circle, oval, square, rectangle, and triangle. In various aspects, the shoulder assembly optionally includes a shoulder assembly cavity, and the oral care composition is enclosed within the housing cavity and the shoulder assembly cavity. In some aspects, the shoulder assembly further comprises a tapered ridge and an intermediate groove which extend proximally from the proximal surface of the shoulder assembly, such that the shoulder assembly may be inserted into the first end of the housing and held therein by a circumferential prong at the first end of the housing, which locks into the intermediate groove. The shoulder assembly preferably includes a plurality of bristles having a maximum length less than 1 cm. in various aspects, the oral care composition optionally comprises one or more of: carriers, cleaning agents, surfactants, thickening agents, buffering agents, whitening agents, sweeteners, and flavorants.

The device optionally includes a removable cap slidably engaged with an external surface of the shoulder assembly and covering the bristles. The cap and shoulder assembly optionally include an internal locking mechanism that snaps together, thereby removably engaging the cap and shoulder assembly together. The cap optionally includes a plug configured such that when the cap is engaged, the plug obstructs the opening. In some aspects, the cap comprises a plurality of holes that provide for aeration of the bristles when not in use.

In some embodiments, the opening, e.g., longitudinally extending opening, includes a valve disposed therein, the valve optionally comprising a membrane having one or more slits disposed therein, through which the oral care composition may be exuded upon rotation of the dial. If present, the valve optionally comprises a membrane having an orifice therein, the orifice having a diameter less than 5 mm.

BRIEF DESCRIPTION OF DRAWINGS

These and other objectives, features, and advantages of the present invention are described in the following detailed description of the specific embodiments and are illustrated in the following Figures in which.

DETAILED DESCRIPTION OF THE INVENTION

Figure 1:
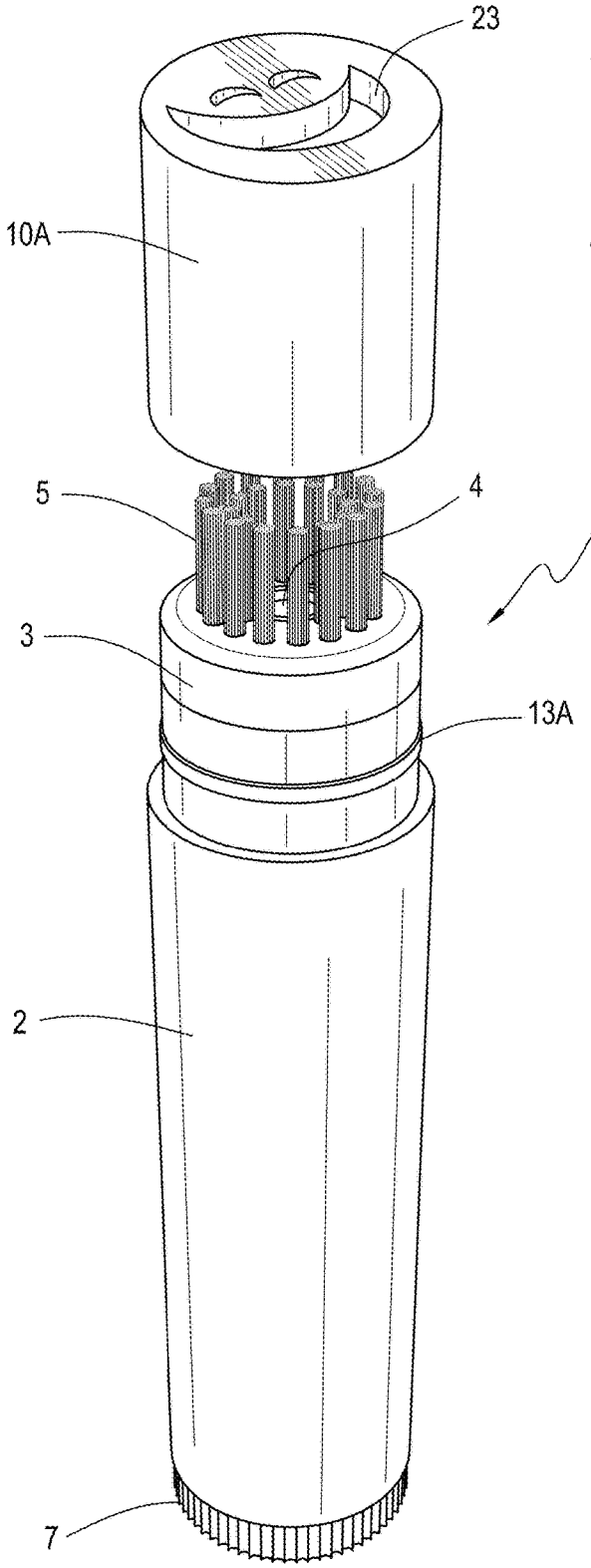
FIG. 1 is a perspective side view of a tooth cleaning device in accordance with one embodiment of the present invention.
Figure 2:
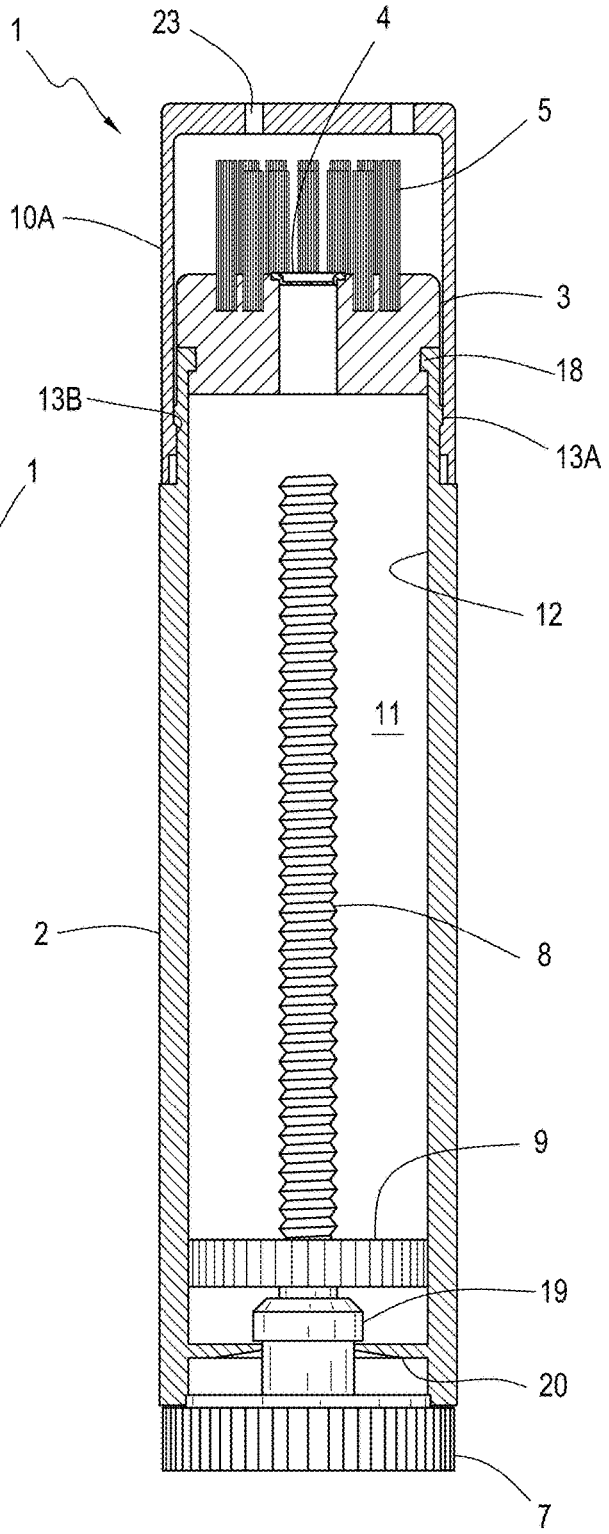
FIG. 2 is a cross-sectional side view of the tooth cleaning device of FIG. 1.
Figure 3:
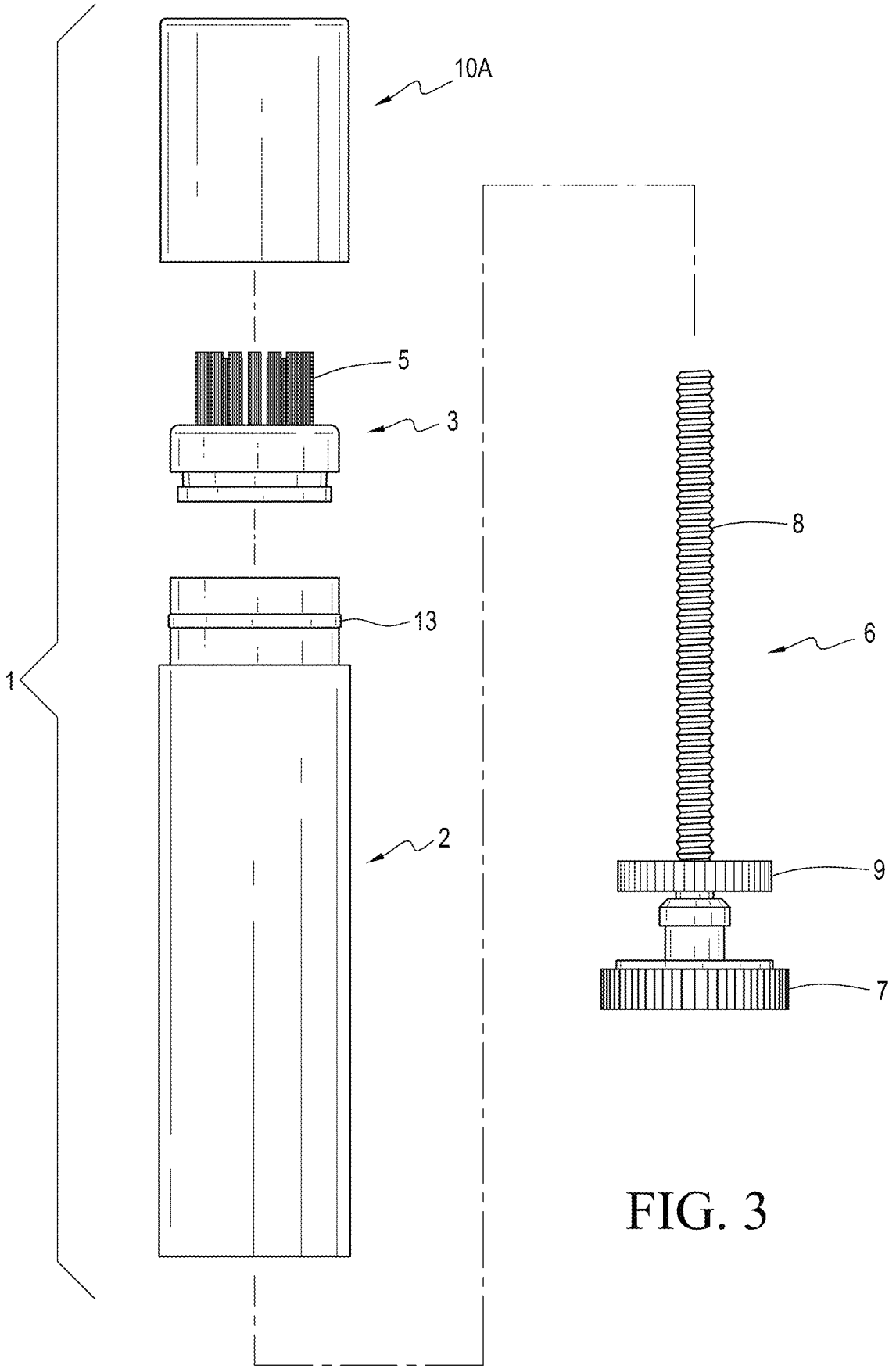
FIG. 3 is an exploded side view of the tooth cleaning device of FIG. 1.

The following detailed description refers to the accompanying drawings. The same reference numbers in different figures identify the same or similar elements.

The following definitions are provided and apply to the present invention. As used herein, the term "proximal" refers to the direction from the device to the user's hand in normal usage of the device. The term "distal" refers to the direction from the device to the user's teeth in normal usage of the device. "Longitudinal" refers to the direction parallel to the longest major length of the device, and "lateral" refers to directions parallel to the width of the device, i.e., normal to the longitudinal direction.

FIGS. 1-6A illustrate a tooth cleaning device 1 according to a first embodiment of the invention, which includes housing 2, shoulder assembly 3 (shown in more detail in FIGS. 4-6), plunger assembly 6, and cap 10. An oral care composition (not shown) preferably is contained within cavity 11 formed within the inner wall(s) 12 of the housing between the shoulder assembly and the plunger assembly. Shoulder assembly 3 includes a plurality of bristles 5 at its distal end that are adapted for use in brushing teeth as well as optionally one or more valves 4 (one is shown) for directing the oral care composition from the cavity to the bristles prior to use. For example, in preferred embodiments, the oral care composition is a gel-like substance, optionally toothpaste, that is preloaded into the cavity during manufacture. The oral care composition may then be dispensed onto the bristles as needed by the user at the time of use by turning dial 7 or otherwise engaging the plunger assembly 6.

In preferred embodiments, as shown in the Figures, the device also includes cap 10, which externally surrounds and removably engages the shoulder assembly, preferably in a slidable relationship, thereby covering bristles 5 when the device is not in use. In preferred embodiments, the cap protects the bristles from damage when the device is not in use. The cap may be slidably removed and replaced by the user, and when firmly pressed onto the shoulder assembly 3, engages the assembly in a removably securable relationship, e.g., through a snap fit.

In preferred embodiments, the cap is designed such that it attaches onto either or both the shoulder assembly and/or housing but may be easily removed by the user. For example, securing of the cap to the housing or shoulder assembly may be achieved with small ridges, bumps, cavities, or other convenient means of fastening the cap to the shoulder assembly and/or housing. In one non-limiting embodiment, shown in FIG. 2, an outwardly laterally extending perimeter ridge 13A (circumferential ridge on devices having a circular cross-section) on the distal outer surface of the housing engages a corresponding inwardly laterally extending perimeter ridge 13B (circumferential cavity on caps having a circular cross-section) on cap 10 so as to removably secure the cap to the housing when the device is not in use. It is contemplated that in some embodiments, not shown, the outward perimeter ridge alternatively may be provided on the outer surface of the shoulder assembly and engage a corresponding perimeter ridge in cap so as to removably secure the cap to the shoulder assembly, and indirectly to the housing, when the device is not in use.

Figure 5:
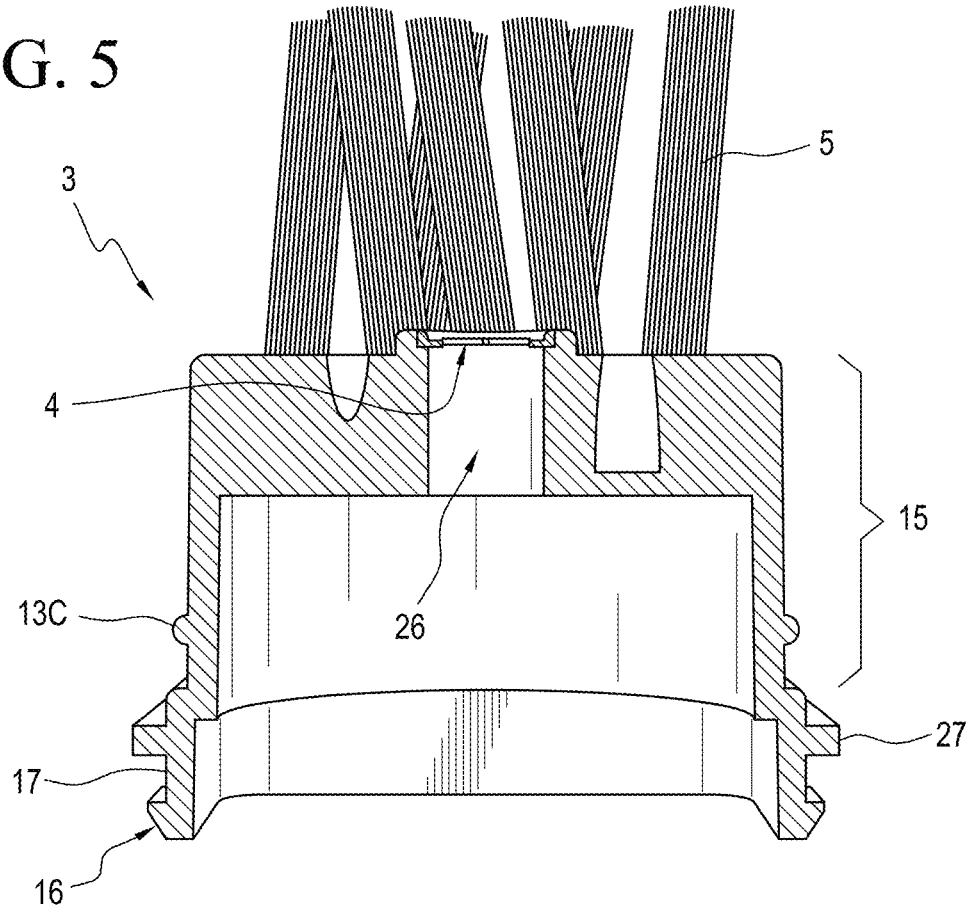
FIG. 5 is a partial cross-sectional view of the shoulder assembly according to one embodiment of the present invention.
Figure 6A:
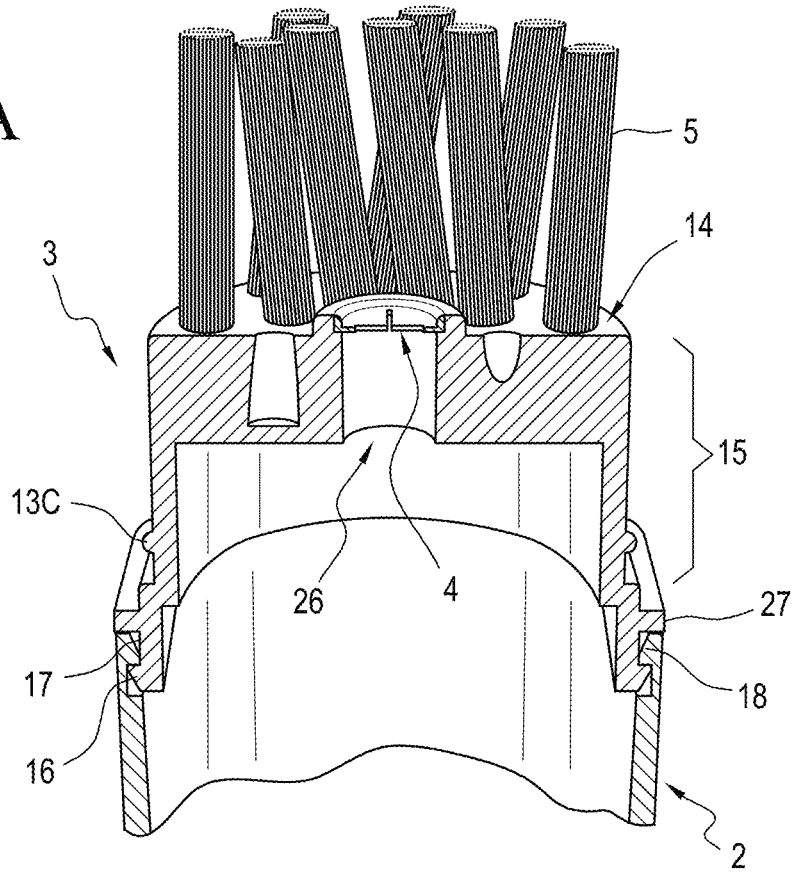
FIG. 6A is a partial cross-sectional view of the housing and shoulder assembly having a valve according to one embodiment of the present invention.
Figure 6B:
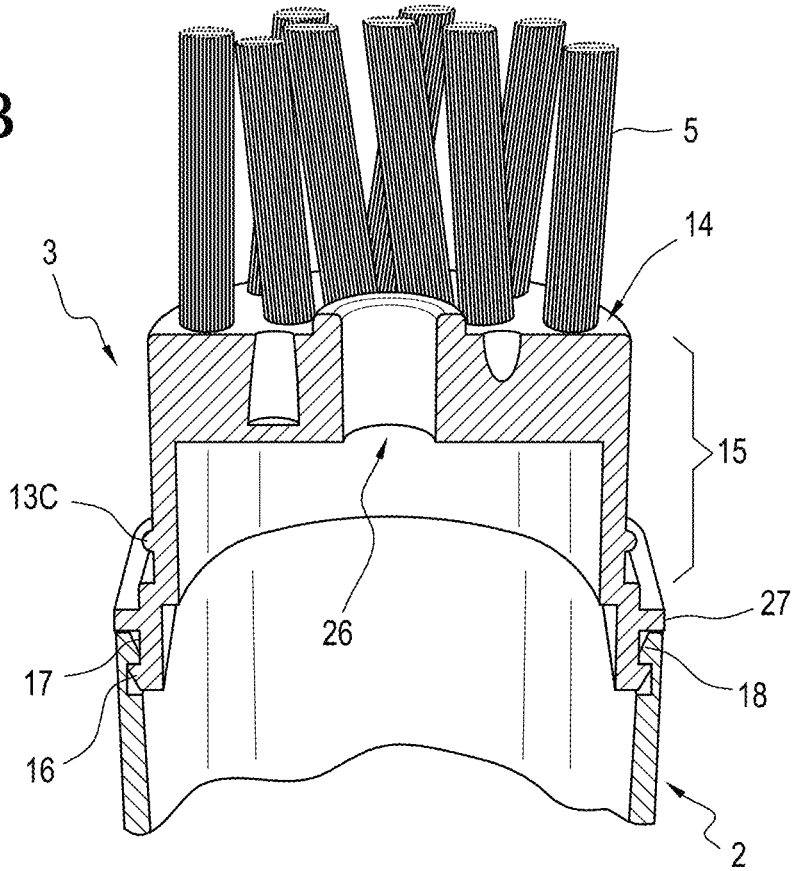
FIG. 6B is a partial cross-sectional view of the housing and shoulder assembly without a valve according to another embodiment of the present invention.
Figure 7:
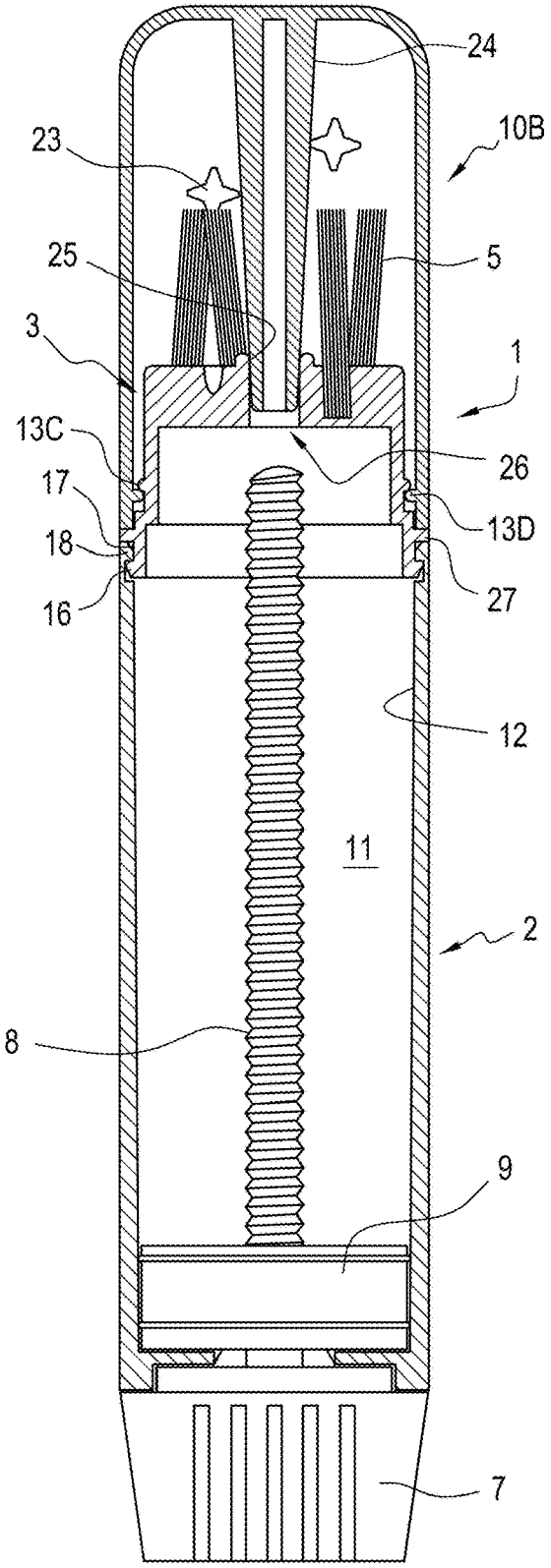
FIG. 7 is a cross-sectional side view of a tooth cleaning device according to one embodiment of the present invention.

In another aspect, shown in FIGS. 5 and 6 (without cap) and FIG. 7 (with cap), an outwardly and laterally extending perimeter ridge 13C (circumferential ridge on devices having a circular cross-section) on the outer surface of the shoulder assembly 3 engages a corresponding inwardly and laterally extending perimeter ridge 13D (circumferential ridge on caps having a circular cross-section) in cap 10 so as to removably secure the cap to the housing when the device is not in use. As shown, the ridges shown in FIGS. 5-7 are in the form of inwardly and outwardly laterally extending rounded "bumps" as opposed to the flattened ridges shown in FIGS. 1 and 2. It is contemplated that in some embodiments, not shown, the perimeter ridges, e.g., bumps, may be provided on the distal outer surface of the housing and engages a corresponding inwardly extending perimeter ridge in cap so as to removably secure the cap to the housing when the device is not in use.

Figure 8:
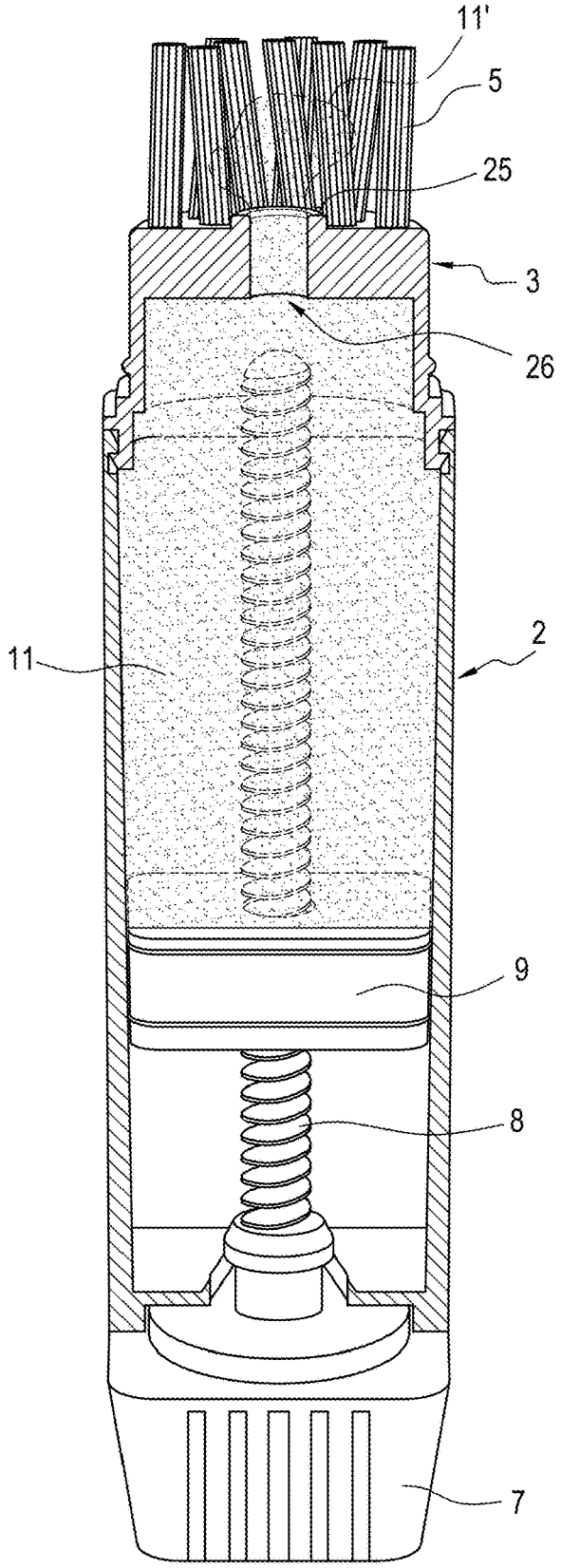
FIG. 8 is a cross-sectional side view of the tooth cleaning device of FIG. 7, showing oral care composition exuded onto its bristles.

In some embodiments, the shoulder assembly includes an opening 26 rather than a valve, which opening permits the oral care composition to exude from the housing onto the bristles prior to usage. In this aspect, it is contemplated that the oral care composition may be sufficiently viscous and/or have sufficient surface tension so as to inhibit leakage through the opening when not in use, even without the use of an additional valve element. Additionally or alternatively, as shown in FIG. 7, a plug 24 may be provided in cap 10 to further inhibit or prevent oral care composition leakage through the opening when the device is not in use. As shown, cap 10 includes a longitudinally extending plug 24 that is adapted to fit into an opening 26 while the cap is engaged with housing 2. In this aspect, the proximal end of the plug matches the size or shape of the opening to inhibit and/or prevent the oral care composition from leaving the cavity. As shown, the valve plug has a tapered shape, e.g., a frustoconical taper, optionally a hollow frustoconical taper, as the plug extends in the proximal direction from an inner laterally extending surface of the cap. The plug aligns with the opening and enters the opening as the cap is placed on the housing and/or shoulder assembly so as to prevent the oral care composition from leaving the cavity while not in use. As shown in FIG. 7, when not in use, plug 24 extends through an optional distally extending rim 25 around opening 26 and into the opening itself. As shown in FIG. 8, just prior to usage, the cap is removed and dial 7 is rotated, causing plunger 9 to move in the distal direction, pressurizing the housing and causing the oral care composition in cavity 11 to exude as exuded oral care composition 11' through opening 26 and onto bristles 5.

Although the Figures illustrate a single opening/valve and a single plug, it is contemplated that in other embodiments the shoulder assembly may comprise a plurality of openings and the cap may comprise a plurality of plugs.

Figure 9:
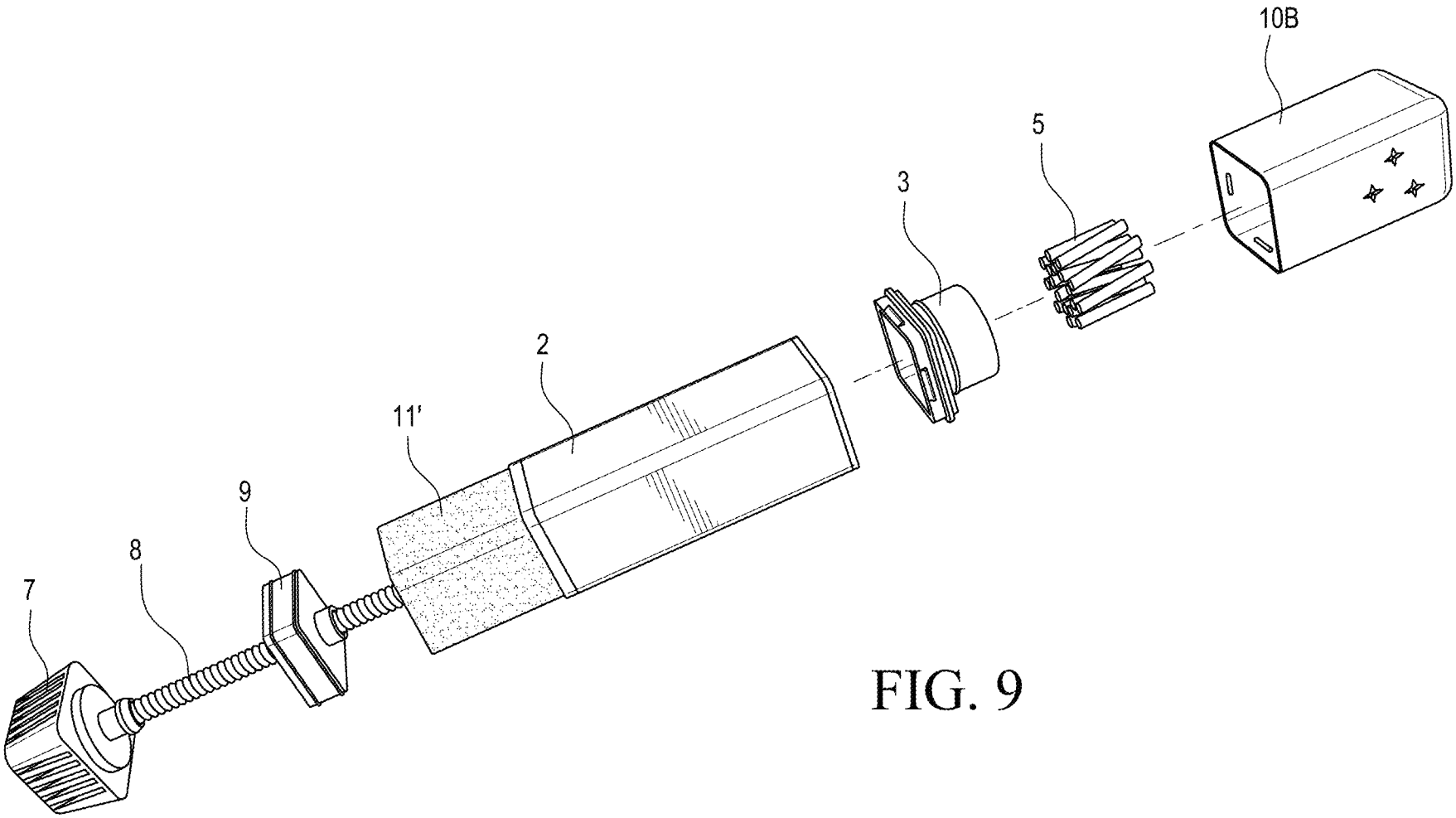
FIG. 9 is an exploded view of the tooth cleaning device of FIGS. 7 and 8.
Figure 10:
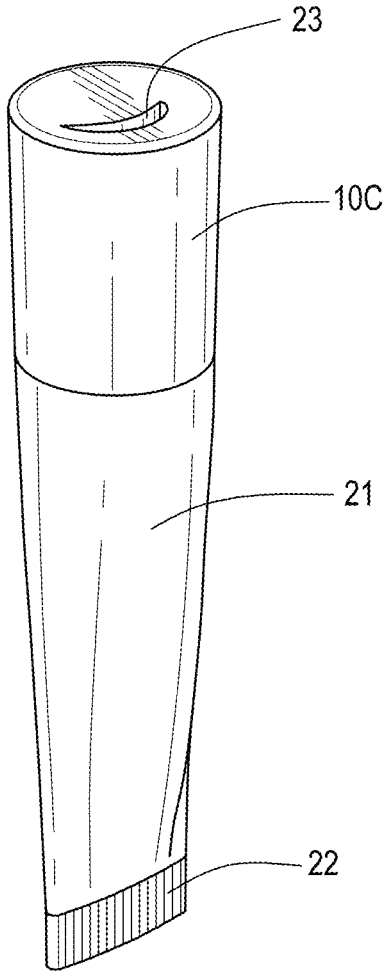
FIG. 10 is a perspective side view of a tooth cleaning device in accordance with another embodiment of the present invention.

In preferred embodiments, shown in FIGS. 1-2, 9, and 10, cap 10 includes one or more holes 23, which allow for aeration of the bristles so as to inhibit growth of mold or bacteria after use of the device. Any number of aeration holes may be provided, e.g., one (as shown), two, or more. The holes may be of any size or shape, so long as they facilitate aeration and drying of the bristles after use. These holes may also be located in any portion of the cap, e.g., the distal end, the side(s), or both. In exemplary embodiments, as shown, aeration is provided by one or more holes, optionally crescent-shaped holes, at the distal end of the cap, or by a plurality of star shaped holes as shown in FIG. 9 on the side of the cap. Three non-limiting cap designs are shown in the figures as cap 10A (FIGS. 1-3), cap 10B (FIGS. 7, 9) and cap 10C (FIG. 10).

In a first embodiment of the invention, the housing is tubular as shown, but in other embodiments, its lateral cross-sectional shape may vary widely. In a preferred embodiment, shown in FIGS. 1-3, housing 2 has a substantially cylindrical shape with a circular lateral cross-section. The housing may alternatively be any prismatic shape, as shown by the square prismatic housings shown in FIGS. 7-9. In various embodiments, the lateral cross-section of the housing may be of circular, elliptical, square, rectangular, triangular, or otherwise polygonal form.

Optionally, housing 2, shoulder assembly 3, and plunger assembly 6 are separable components, meaning they are separately manufactured and assembled prior to use. Preferably, the shoulder assembly connects to a first end of the housing, and the plunger assembly connects to a second end of the housing, as shown. The housing, shoulder assembly, and plunger assembly may be formed of a variety of materials, but preferably are substantially rigid, and optionally formed of a variety of a plastic, such as polyethylene and/or polypropylene, optionally in combination with one or more other plastics, silicone, nylon, or a combination thereof. The housing, shoulder assembly, and plunger assembly may each be formed of the same or of different materials, and they may be of the same or of different colors. Each of the housing, shoulder assembly, and plunger assembly may be formed of opaque, translucent, or transparent materials, or a combination thereof.

As shown in FIGS. 1-3 and 7-9, the shoulder assembly 3 covers an opening at the first end of the housing. Various different shoulder assemblies are illustrated in FIGS. 4-6B. In each embodiment, the shoulder assembly comprises a proximal end that engages a distal end of the housing 2, a shoulder region 15 having a distal surface 14, a plurality of bristles 5 secured to the shoulder region and extending distally from the distal surface 14, and an opening 26 extending longitudinally therethrough for allowing transfer of the oral care composition from the cavity to the region of the bristles during normal usage. FIGS. 1, 2 and 4-6A also show valve 4, disposed at the distal end of opening 26. In these embodiments, the cavity in the housing is sealed by a single valve 4 at opening 26, which is positioned centrally in the shoulder assembly. A plurality of bristles 5 extend distally from the shoulder assembly region surrounding the opening 26.

In some embodiments, for example as shown in FIGS. 1-4, the cavity for holding the oral care composition does not extend into the shoulder assembly. In other embodiments, for example as shown in FIGS. 5-9, the cavity extends into the shoulder assembly itself, i.e., into a shoulder assembly cavity. Thus, in this aspect, the shoulder assembly includes a shoulder assembly cavity, and the oral care composition is enclosed within the housing cavity and the shoulder assembly cavity. In either case, the cavity terminates at a proximal surface of the shoulder assembly. In the latter aspect, the shoulder assembly preferably includes an opening extending laterally from the shoulder assembly cavity to a distal surface of the shoulder assembly such that during use, the oral care composition can be exuded through the opening onto the distal surface and/or onto the bristles on the distal surface of the shoulder assembly.

Figure 4:
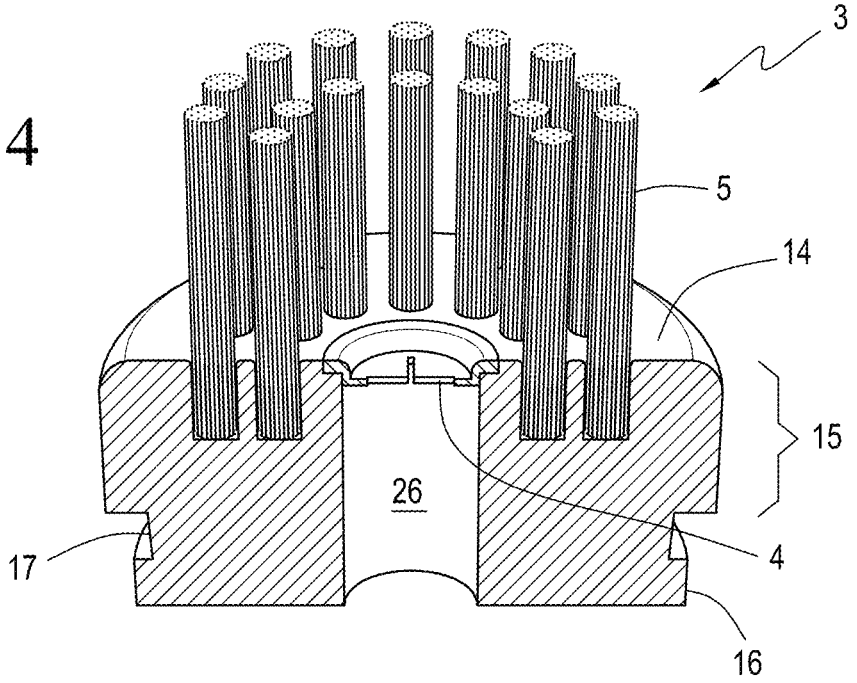
FIG. 4 is a perspective partial cross-sectional view of the shoulder assembly according to one embodiment of the present invention.

As indicated above, the opening optionally includes a valve disposed therein. Optional valve 4 is configured to regulate dispensing of the oral care composition from the cavity in the housing 2 to the bristles 5. In some embodiments, the valve is formed by a membrane extending across a distal opening 26 (a conduit that extends longitudinally through the shoulder assembly 3) and includes one or more orifices, which may comprise one or more slits, holes, or other openings. A preferred embodiment has a singular orifice, which is in the shape of a small hole. Alternative embodiments may include multiple slits that connect to form a plurality of leaves in the membrane, as shown in FIG. 4. When the cavity is pressurized for dispensing, e.g., by activating the plunger assembly 6, for example by turning dial 7, the oral care composition exudes through the opening 26 and, if present, through optional valve 4, such that the oral care composition coats the bristles for use. A further description of valves is disclosed in U.S. Pat. No. 8,016,162, the entirety of which is incorporated herein by reference.

As shown in FIGS. 1-7, the bristles 5 may be attached to the perimeter of the distal side of the shoulder assembly 3 during manufacture. As shown, the bristles may be attached in a plurality of rows along the perimeter of the shoulder assembly around the opening and optional valve. In a preferred embodiment, the bristles extend in the longitudinal direction, distally from the shoulder assembly. In alternative embodiments, as shown in FIGS. 5-9, the bristles may extend out at varying angles from the shoulder assembly, e.g., from 35 to 55 degrees, from 40 to 60 degrees, or other angles, to increase resistance in brushing the teeth while the device is in use. This may allow for increased cleanliness by facilitating dispersion of the oral care composition or removal of stains from the teeth.

The bristles 5 are preferably made of soft, pliable material. In some embodiments, the bristles may be formed of a material selected from plastic, polypropylene, silicone, nylon, and combinations thereof. Each bristle may be cylindrical in shape with a flat tip or may be in conical form, or they may have a different cross-sectional shapes, e.g., rectangular, triangular, or other shapes. The bristles preferably have a maximum length that is less than 1 cm, e.g., less than 0.75 cm, less than 0.5 cm, or less than 0.25 cm. In terms of ranges, the bristles preferably have a maximum length from 0.25 cm to 1 cm, e.g., from 0.5 cm to 0.75 cm or from 0.25 cm to 0.5 cm.

It is to be understood the specific illustration of the bristles is merely for describing one non-limiting embodiment of the present invention. The invention can, however, be practiced with various combinations of the same or different bristles configurations. It is thereby possible to select the combination of bristle configurations, bristle materials and bristle orientations to achieve specific intended results, such as enhanced cleaning, tooth polishing, breath freshening, tooth whitening, and/or massaging of the gums The manner in which shoulder assembly attaches to the housing may vary. In preferred embodiments, as shown in FIGS. 1-7, the proximal side of shoulder assembly 3 forms a ridge 16 and an intermediate groove 17. A prong 18 at the distal end of the housing 2 fits into corresponding groove 17 in shoulder assembly 3. The prong preferably is formed at a circumferential edge of the opening in the housing and fastens to the shoulder assembly by hooking into the intermediate groove 17. The ridge in the shoulder assembly is preferably tapered such that the ridge widens toward the intermediate groove, so as to facilitate insertion of the shoulder assembly into the housing and simultaneously hinder removal of the shoulder assembly from the housing. In one embodiment, the housing attaches to the shoulder assembly with a singular circumferential prong about the edge of the housing, but the housing may alternatively attach to the shoulder assembly with multiple prongs, e.g., two prongs, three prongs, or more, arranged about the edge. The embodiment shown in FIGS. 1-4 has a substantially squared off prong, while the embodiments in FIGS. 5-8 have more angled prong. The shoulder assembly in the embodiments in FIGS. 5-8 also include a lateral perimeter flange 27 that abuts and separates the distal end of the housing and the proximal end of the cap (when in place). The orientation of the lateral perimeter flange 27 between the housing and cap is best seen in FIG. 7. Of course, other configurations for securing the shoulder assembly to the housing may be employed.

In preferred embodiments, the tooth cleaning device includes a plunger assembly 6, which comprises a rotatable dial 7 connected to a helically grooved shaft 8 and a non-rotatable plunger 9. The shaft extends into the cavity, and the plunger is connected to the shaft through a central opening in the plunger. The plunger extends laterally from the shaft so that it is slidably engaged with the inner wall of the housing. The plunger is preferably rendered non-rotatable by one or more ridges and grooves (not shown) that slidably couple or engage the plunger to the housing, by the shape of the plunger and the housing (e.g. a square or rectangular cross-section, such that the corners of the of the plunger prevent the plunger from rotating but permits distal longitudinal movement of the plunger as dial 7 is rotated), or by other convenient means. The helical grooves of the shaft are preferably disposed at an angle such that rotation of dial 7 serves to advance the plunger along the shaft in the distal direction, as described, for example, in U.S. Pat. No. 6,283,658, the entirety of which is incorporated herein by reference.

In a preferred embodiment, plunger assembly 6 attaches to the second end of the housing by any convenient fastening means. In the embodiment shown in FIG. 2, a locking mechanism 19 extends through a central opening in a laterally-extending closure 20 at the proximal end of the housing, which is preferably integrally formed with housing 2. Closure 20 preferably includes a clasp that inhibits or prevents detachment of the plunger assembly from the device after device assembly.

In this embodiment, the user dispenses the oral care composition by rotation of the dial, e.g., in a clock-wise direction. Because the plunger does not rotate with the shaft, rotation of the dial causes the shaft to rotate, which in turn causes the plunger to move distally toward the shoulder assembly, decreasing the volume of the cavity in which the oral care composition is stored and thereby forcing the oral care composition through the opening and/or valve in the shoulder assembly and onto the bristles.

FIG. 10 illustrates a second embodiment of the tooth cleaning device, which does not include a plunger assembly to dispense the oral care composition nor a rigid housing. Instead, housing 21 in this embodiment is flexible and tapers to an enclosed second end comprising a seam 22. The oral care composition is contained within the cavity formed within the housing, and may be forced through the opening and/or valve of the shoulder assembly by compression, e.g., by squeezing the housing between the user's fingers.

In this second embodiment, the lateral cross-sectional shape of the housing may vary widely, but the housing preferably tapers to a closure at the second end. In a preferred embodiment, shown in FIG. 10, housing 21 has a substantially circular lateral cross-section at its distal end and tapers to a linear seam at its proximal end. The housing may alternatively have a lateral cross-section that is circular, oblong, elliptical, rectangular, triangular, or otherwise polygonal. In a preferred embodiment, the second end of the housing is formed by a heat seal, but it may alternatively be formed by other convenient means. The housing of this embodiment may be formed of plastic or some other material so long as the material is capable of being deformed under manual pressure so as to increase pressure within the cavity and cause the oral care composition to effuse out of the valve and onto the bristles.

In the second embodiment of FIG. 10, the cap and shoulder assembly may be the same or substantially similar to the cap and shoulder assembly described above in connection with FIGS. 1-9.

Process for Using Tooth Cleaning Device

The invention is also directed to a process for using any of the above-described tooth cleaning devices. In one aspect, for example, the process involves the use of a device of the type described above and shown in FIGS. 1-3 or 7-9, wherein the device comprises a rigid housing and a plunger assembly, and comprises the steps of: (a) gripping the housing; (b) rotating the dial so as to rotate the shaft and cause the non-rotatable plunger to slide toward the shoulder assembly, thereby decreasing the cavity volume and forcing the oral care composition through the opening and/or valve and onto the bristles; and (c) activating the oral care composition with the user's saliva and brushing the user's teeth with the bristles.

In a second aspect, for example, the process involves the use of a device of the type described above and shown in FIG. 10, wherein the device comprises a flexible housing but lacks a plunger assembly, and comprises the steps of: (a) gripping the housing; (b) compressing the flexible housing by the user so as to decrease the volume of the cavity and force the oral care composition through the opening and/or valve and onto the bristles; and (c) activating the oral care composition with the user's saliva and brushing the user's teeth with the bristles.

Oral Care Composition

As discussed above, the tooth cleaning device may comprise an oral care composition. The oral care composition may be impregnated, coated, layered, or otherwise preloaded into the device. An exemplary oral care composition is disclosed in U.S. Pat. No. 8,715,625, which is incorporated herein by reference in its entirety. Unless otherwise stated, amounts listed in percentage are in weight percent ("wt. %"), based on the total weight of the oral care composition.

The oral care composition may comprise one or more of the following: carriers, cleaning agents, surfactants, thickening agents, buffering agents, whitening agents, sweeteners, and/or flavorants.

As in most commercially available oral care compositions, an inert carrier is the primary ingredient in the oral care compositions. The amount of the carrier in the overall oral care composition may vary from 30% to 75%, e.g. from 35% to 70%, from 40% to 60%, from 50% to 75%. The common inert carrier is water. Other examples of carriers may include sorbitol, glycerol, vegetable glycerin, and combinations thereof.

The cleaning agent, optionally a cleaning solvent, may be used to remove stains from the tooth and should be orally acceptable (non-toxic). The amount of the cleaning agent in the overall oral composition may vary from 0.1% to 5%, e.g., from 0.1% to 3%, 0.5% to 3%, from 1% to 4%. Preferably, the cleaning agent is water miscible and hydrophilic. Without being bound by theory, the cleaning agent preferably improves the wetting properties of the overall oral care composition to allow for better penetration of the tooth surface and thereby improved stain removal. Examples of cleaning agents include water, deionized water, purified water, ethanol, glycerol, propylene glycol, PEG-60, PEG-400, PEG-600, benzyl alcohol, methyl salicylate, phenol, acrylic acid, orange oil, acetic acid, vinegar, acetone, formic acid, methanol, propanol, ethanolamine, lactic acid ethyl ester, propionic acid, diethanolamine, triethanolamine, diethylene glycol, diethylamine, triethylamine, tetraethylene glycol, formaldehyde, 1-octanol, and mixtures thereof. In some embodiments, the cleaning agent may comprise water and/or ethanol. In some embodiments, the cleaning agent comprises fluoride.

The amount of surfactant in the overall oral composition may vary from 0.1% to 5%, e.g., from 0.1% to 3%, 0.5% to 3%, from 1% to 4%. Preferred surfactants include non-ionic surfactants, cationic surfactants and/or anionic surfactants. Examples of surfactants include sodium lauryl sulfate (SLS), sodium-N-lauroyl sarcosinate, Pluronic F68, Pluronic F88, poloxamer 188, poloxamer 124, poloxamer 338, poloxamer 407, dioctyl sodium sulfosuccinate, ethylene oxide polymer, polyethyloxylated castor oil, cremophor 40, hydrogenated castor oil, and mixtures thereof.

Non-ionic surfactants may be selected from the group consisting of phosphates, sulfates, polysorbates, sorbitan esters, polyoxyethylene sorbitan esters, low viscosity hydroxyethyl cellulose, polysorbates, fatty alcohol ethoxylates, monoglycerides, soybean lecithin, polyethylene oxide condensates of alkyl phenols, products derived from the condensation of ethylene oxide with the reaction product of propylene oxide and ethylene diamine, ethylene oxide condensates of aliphatic alcohols, long chain tertiary amine oxides, long chain tertiary phosphine oxides, long chain dialkyl sulfoxides, and mixtures thereof. Anionic and amphoteric surfactants may include, but are not limited to, derivatives of aliphatic secondary and tertiary amines in which the aliphatic component may be a straight chain or branched. The aliphatic substituents may contain from about 8 to about 18 carbon atoms and one may contain an anionic water-solubilizing group, e.g., carboxylate, sulfonate, sulfate, phosphate, phosphonate, betaines (e.g., cocamidopropyl betaine), or a mixture thereof. Many of these nonionic and amphoteric surfactants are disclosed in U.S. Pat. No. 4,051,234, which is incorporated herein by reference in its entirety.

Cationic surfactants that may be useful in the oral care composition may be broadly defined as a derivative of aliphatic quaternary ammonium compounds having one long (e.g., $C_{8-18}$) alkyl chain. The cationic surfactant may also act as a germicide. Examples of cationic surfactants include lauryl trimethylammonium chloride, cetyl pyridinium chloride, cetyl trimethylammonium bromide, diisobutylphoxyethyl-dimethylbenzylammonium chloride, coconut alkyltrimethylammonium nitrite, and those described in U.S. Pat. No. 3,535,421, the entirety of which is incorporated herein by reference.

Additional surfactants may include sodium carbonate (anhydrous), sodium bicarbonate (baking soda), potassium iodide, and mixtures thereof. In one embodiment, the surfactant is a combination of a block co-polymer of polyoxyethylene and polyoxypropylene, e.g., poloxamer 407, and hydrogenated castor oil.

A buffering agent may be used to adjust the pH of the oral care composition. The amount of the buffering agent in the overall oral composition may vary from 0.1% to 5%, e.g., from 0.1% to 3%, 0.5% to 3%, from 1% to 4%. Preferably, the amount of buffering agent will be sufficient to adjust the pH of the oral care composition to an acceptable range, e.g., from 4 to 9, from 5 to 8, from 6 to 8. Examples of buffering agents include potassium hydroxide (KOH), ammonium hydroxide, sodium citrate, sodium bicarbonate (baking soda), sodium hydroxide, calcium hydroxide, calcium phosphate tribasic, dipotassium phosphate, sodium monobasic phosphate and sodium dibasic phosphate (optionally anhydrous), sodium aluminum phosphate, sodium tripolyphosphate, sodium benzoate, acetic acid, sodium acetate, citric acid, sodium citrate, benzoic acid, sodium hexametaphosphate, and mixtures thereof.

Thickening agents may be used to adjust the viscosity of the oral care composition. The amount of thickening agents in the overall oral composition may vary from 0.1% to 5%, e.g., from 0.1% to 3%, 0.5% to 3%, from 1% to 4%. Examples of thickeners include hydrocolloids, e.g., guar gum, locust bean gum, gum acacia, alginic acid, carrageenan, gelatin, methylcellulose, sodium carboxymethylcellulose, polyacrylates, polyethylene oxides, carnauba wax, beeswax, paraffin, mineral oil, and mixtures thereof.

The amount of whitening agents in the overall oral composition may vary from 0.1% to 25%, e.g., from 0.1% to 15%, from 0.1% to 10%, from 1% to 10%. Examples of whitening agents include peroxygens, peroxides, metal chlorites, perborates, percarbonates, peroxyacids, persulfates and mixtures thereof. For example, the whitening agent may comprise one or more of hydrogen peroxide, carbamide peroxide, calcium peroxide, glyceryl peroxide, benzoyl peroxide, calcium chlorite, barium chlorite, magnesium chlorite, lithium chlorite, sodium chlorite, potassium chlorite, sodium hypochlorite, chlorine dioxide, and the like.

The addition of sweeteners is important to make the oral care composition palatable. The amount of sweetener in the overall oral composition may vary from 0.1% to 25%, e.g., from 0.1% to 15%, from 0.1% to 10%, from 1% to 10%. Preferably, the amount of sweetener in the overall oral care composition is sufficient to render the composition palatable to the user. The sweetener is preferably water soluble and may be natural or artificial. Examples of sweeteners include xylose, ribose, glycose, mannose, galactose, glucose, fructose, dextrose, sucrose, maltose, sorbitol, xylitol, mannitol, sodium saccharin, calcium saccharin, sucralose, 3,6-dihydro-6-methyl-1,2,3-oxanthiazin-4-one-2,2-dioxide, potassium (Acesulfame-K), and mixtures thereof.

The flavor of an oral care composition is an important consideration of consumers. As such, the oral care composition may comprise a flavorant, which may be used to enhance the flavor and palatability of the composition. The amount of flavorant in the overall oral composition may vary from 0.1% to 25%, e.g., from 0.1% to 15%, from 0.1% to 10%, from 1% to 10%. Preferably, the amount of flavorant in the overall oral care composition is sufficient to render the composition palatable to the user. Examples of flavorants include natural peppermint flavor, anise oil, clove oil, peppermint oil, spearmint oil, menthol, methyl salicylate, blackberry, strawberry, chocolate, vanilla, cherry, grape, lime, lemon, mint, and the like.

The oral care composition may also include one or more additional additives, such as: (i) abrasives e.g., mica, calcium phosphates, sodium bicarbonate (baking soda), alumina, calcium carbonate (chalk), silica; (ii) preservatives, e.g., potassium sorbate; (iii) chelating agents, e.g., etidronic acid; (iv) tartar control ingredients, e.g., disodium pyrophosphate; (v) colorants, e.g., titanium dioxide, mica; (vi) antioxidants, e.g., fluorides including potassium stannate; (vii) vitamins; (viii) plant extracts. Additionally, any other ingredients generally known to those skilled in the art may be included in the oral care composition.

In some embodiments, the oral care composition comprises one or more of water, baking soda, titanium dioxide, sorbitol, potassium sorbate, cetyl pyridinium chloride, xylitol, guar gum, sodium benzoate, methanol, ammonium hydroxide, etidronic acid, disodium pyrophosphate, potassium stannate, hydrogenated castor oil, PEG-60, carnauba wax, mica, natural peppermint flavor, sucralose, sodium saccharin, carbomer, ethanol and poloxamer 407. In some aspects, the oral care composition comprises fluoride. In some embodiments, the oral care composition comprises carbon, e.g., activated charcoal.

In addition to the cosmetic benefits, the disposable tooth cleaning device of the present invention also provides economic benefits in the form of an inexpensive tooth cleaning device that is both quickly and economically manufactured. The present invention also provides a convenience benefit as it allows for maintenance of oral health without the need for toothpaste, water, mouth wash, a toothbrush, or containers to hold same.

Other embodiments of the invention will be apparent to those skilled in the art from consideration of the specifications and practice of the invention disclosed herein. It is intended that the specification and examples be considered as exemplary only, with a true scope and spirit of the invention being indicated by the following claims.

I claim:

1. A multiuse tooth cleaning device, comprising:

an elongated housing having a first cylindrical end and a second cylindrical end;

a shoulder assembly attached to the housing at the first cylindrical end and comprising a plurality of bristles attached to a distal surface thereof, the shoulder assembly further comprising an intermediate groove at its proximal side; and a plunger assembly comprising a rotatable dial at the second cylindrical end of the housing coupled to a helically grooved shaft, and a non-rotatable laterally extending plunger having an outer surface slidably engaged with an inner wall of the housing and a central opening engaged with the helically grooved shaft, wherein the housing defines a housing cavity between the shoulder assembly and the plunger, the housing cavity containing an oral care composition therein, and wherein rotation of the dial causes the shaft to rotate and the non-rotatable plunger to slidably move in the distal direction thereby decreasing housing cavity volume and pushing the oral care composition out of the housing cavity through an opening in the shoulder assembly and onto the bristles, and wherein the housing includes a prong at its circumferential edge, engaged with the intermediate groove of the shoulder assembly.

2. The device of claim 1, wherein the shoulder assembly includes a shoulder assembly cavity, and the oral care composition is enclosed within the housing cavity and the shoulder assembly cavity.

3. The device of claim 1, further comprising a removable cap slidably engaged with an external surface of the shoulder assembly and covering the bristles, wherein the cap includes a plug configured such that when the cap is engaged, the plug obstructs the opening.

4. The device of claim 3, wherein the cap comprises a plurality of holes that provide for aeration of the bristles when not in use.

5. The device of claim 1, wherein the shoulder assembly further comprises a tapered ridge extending proximally from the shoulder assembly, such that the shoulder assembly may be inserted into the first cylindrical end of the housing and held therein by the prong, which locks into the intermediate groove.

6. The device of claim 1, wherein the housing has a lateral cross-sectional shape selected from the group consisting of circle, oval, square, rectangle, and triangle.

7. The device of claim 1, wherein the opening includes a valve disposed therein, the valve comprising a membrane having one or more slits disposed therein, through which the oral care composition may be exuded upon rotation of the dial.

8. The device of claim 1, wherein the opening includes a valve disposed therein, the valve comprising a membrane having an orifice therein, the orifice having a diameter less than 5 mm.

9. The device of claim 1, wherein the bristles have a maximum length less than 1 cm.

10. The device of claim 1, wherein the oral care composition comprises one or more of: carriers, cleaning agents, surfactants, thickening agents, buffering agents, whitening agents, sweeteners, and flavorants.

11. The device of claim 1, wherein the prong is angled.

12. The device of claim 1, wherein the shoulder assembly and housing are engaged by interlocking prongs.

13. The device of claim 12, wherein the prongs are angled.

14. The device of claim 1, wherein the shoulder assembly further comprises a ridge at its proximal side.

15. The device of claim 14, wherein the ridge widens toward the intermediate groove.

16. The device of claim 1, wherein the shoulder assembly further comprises a lateral perimeter flange.

17. A process for using a multiuse tooth cleaning device, comprising:

(a) providing the multiuse tooth cleaning device, the device comprising:

an elongated housing having a first cylindrical end and a second cylindrical end;

a shoulder assembly attached to the housing at the first cylindrical end and comprising a plurality of bristles attached to a distal surface thereof, the shoulder assembly further comprising an intermediate groove at its proximal side; and a plunger assembly comprising a rotatable dial at the second cylindrical end of the housing coupled to a helically grooved shaft, and a non-rotatable laterally extending plunger having an outer surface slidably engaged with an inner wall of the housing and a central opening engaged with the helically grooved shaft, wherein the housing defines a cavity between the shoulder assembly and the plunger, the cavity containing an oral care composition therein, and wherein the housing includes a prong at its circumferential edge, engaged with the intermediate groove of the shoulder assembly;

(b) gripping the housing;

(c) rotating the dial so as to rotate the shaft causing the non-rotatable plunger to slidably move in the distal direction thereby decreasing the cavity volume and pushing the oral care composition out of the cavity through the opening and onto the bristles; and (d) activating the oral care composition with the user's saliva and brushing the user's teeth with the bristles.

18. A multiuse tooth cleaning device, comprising:

an elongated housing having a first cylindrical end and a second cylindrical end;

a shoulder assembly attached to the housing at the first cylindrical end and comprising a plurality of bristles attached to a distal surface thereof, the shoulder assembly including a central opening extending longitudinally therethrough aligned with a central longitudinal axis of the device;

a plunger assembly comprising a rotatable dial at the second cylindrical end of the housing coupled to a helically grooved shaft, and a non-rotatable laterally extending plunger having an outer surface slidably engaged with an inner wall of the housing and a central opening engaged with the helically grooved shaft; and a removable cap slidably engaged with an external surface of the shoulder assembly and covering the bristles, wherein the cap includes a plug configured to extend into the central opening of the shoulder assembly when the cap is engaged with the external surface of the shoulder assembly, wherein the housing defines a housing cavity between the shoulder assembly and the plunger, the housing cavity containing an oral care composition therein, and wherein rotation of the dial causes the shaft to rotate and the non-rotatable plunger to slidably move in the distal direction thereby decreasing housing cavity volume and pushing the oral care composition out of the housing cavity through the central opening in the shoulder assembly and onto the bristles.

* * * * *